US010144552B2

(12) United States Patent
Lisek et al.

(10) Patent No.: US 10,144,552 B2
(45) Date of Patent: Dec. 4, 2018

(54) PAPER BAG

(71) Applicant: dy-pack Verpackungen Gustav Dyckerhoff GmbH, Wenden-Gerlingen (DE)

(72) Inventors: Eduard Lisek, Drolshagen (DE); Gerhard Schulte, Lindar/Frielingsdorf (DE); Michael Merschmann, Kierspe (DE); Jens Stamm, Drolshagen/Benolpe (DE)

(73) Assignee: dy-pack Verpackungen Gustav Dyckerhoff GmbH, Wenden-Gerlingen (DE)

( * ) Notice: Subject to any disclaimer, the term of this patent is extended or adjusted under 35 U.S.C. 154(b) by 0 days.

(21) Appl. No.: 15/110,792

(22) PCT Filed: Nov. 26, 2014

(86) PCT No.: PCT/EP2014/003162
§ 371 (c)(1),
(2) Date: Jul. 11, 2016

(87) PCT Pub. No.: WO2015/104038
PCT Pub. Date: Jul. 16, 2015

(65) Prior Publication Data

US 2016/0332781 A1 Nov. 17, 2016

(30) Foreign Application Priority Data

Jan. 10, 2014 (DE) ..... 20 2014 000 194 U

(51) Int. Cl.
*B65D 33/01* (2006.01)
*B65D 30/08* (2006.01)
(Continued)

(52) U.S. Cl.
CPC ..... *B65D 31/02* (2013.01); *B65D 31/04* (2013.01); *B65D 31/08* (2013.01); *B65D 31/142* (2013.01); *B65D 33/01* (2013.01)

(58) Field of Classification Search
CPC ..... B65D 33/01; B65D 31/08; B65D 31/14; B65D 31/142; B65D 31/145; B65D 31/147; B65D 2205/00; B65D 2205/02
(Continued)

(56) References Cited

U.S. PATENT DOCUMENTS 3,085,737 A * 4/1963 Horton ..... B65D 33/01 383/101
3,309,006 A * 3/1967 Perry ..... B65D 33/01 383/100
(Continued)

FOREIGN PATENT DOCUMENTS

CN 2707652 Y 7/2005
CN 101132970 A 2/2008
(Continued)

OTHER PUBLICATIONS

JP2003170945Translation.*
JP11079198Translation.*

*Primary Examiner* — Jes F Pascua
*Assistant Examiner* — Nina Attel
(74) *Attorney, Agent, or Firm* — Dilworth & Barrese, LLP

(57) ABSTRACT

A paper sack for bulk material such as cement, gypsum, granulate, animal feed or similar, having a base, preferably a cross bottom or block bottom, and having an upper part which is disposed opposite the base and in which a valve tube is optionally arranged for filling the paper sack, wherein the paper sack has at least one paper layer having an overlap which is sealingly adhesively bonded toward the sack interior; and wherein the layer of the paper layer facing the sack
(Continued)

interior has an air-permeable region in the region of the overlap which is covered by the layer of the paper layer facing the sack exterior. The at least one paper layer at least regionally has a water-repellent/water-tight coating facing the sack exterior.

13 Claims, 5 Drawing Sheets

(51) Int. Cl.
*B65D 30/18* (2006.01)
*B65D 30/24* (2006.01)

(58) Field of Classification Search
USPC ..... 383/100–103
See application file for complete search history.

(56) References Cited

U.S. PATENT DOCUMENTS 5,493,844 A * 2/1996 Combrink ..... B65B 51/146 53/410
2005/0281494 A1* 12/2005 Allen ..... B65D 33/01 383/109
2008/0152266 A1* 6/2008 Bergmann ..... B65D 33/01 383/103
2009/0148636 A1 6/2009 Wallat
2010/0158417 A1* 6/2010 Sharp ..... B32B 27/10 383/94

FOREIGN PATENT DOCUMENTS

DE 2 319 672 A1 11/1974
DE 698 14 470 T2 3/2004
DE 10 2004 013 469 A1 10/2005
DE 20 2005 003 539 U1 7/2006
DE 10 2005 035 352 A1 2/2007
EP 1 813 545 A1 8/2007
EP 1 858 769 B1 10/2008
JP S55-148054 U 10/1980
JP 11079198 A * 3/1999
JP 2000-153855 A 6/2000
JP 2003170945 A * 6/2003
JP 2007-535447 A 12/2007
JP 2013-147255 A 8/2013
WO 2007/027425 A1 3/2007
WO 2010075146 A2 7/2010
WO 2014/177248 A1 11/2014

* cited by examiner

PAPER BAG

BACKGROUND OF THE INVENTION

The invention relates to a paper sack, preferably to a valve paper sack for bulk material such as cement, gypsum, granulate, animal feed or similar, having a base, preferably a cross bottom or block bottom, and having an upper part which is disposed opposite the base and in which a valve hose is optionally arranged for filling the paper sack.

Such paper sacks are known, for example, from EP 1 858 769 B1. The typical sizes 5 kg, 10 kg or 25 kg are in particular commercially widespread. They have one or more paper layers which are formed from paper or from a paper composite and/or from coated paper.

A valve hose is optionally provided for filling such sacks which is worked into the upper part and which is placed onto a filler nozzle for filling. A fast escaping of the air during the filling process is of material significance for a fast and economic filling. On the other hand, the sack should be as leak-proof as possible after the filling. To achieve a greater product protection or a longer product stability of the filling material, a barrier layer can—as described in EP 1 858 769 B1—be placed between an inner layer and an outer layer of paper.

It has been found that a sufficient product protection cannot be ensured with the already known sacks with sensitive filling materials. Such sensitive filling materials are, for example, fast-binding products in the sector of construction materials or foodstuffs in which a loss of aroma has to be prevented.

In addition there is a demand for so-called weatherproof paper sacks whose outwardly disposed side has water-resistant or weather-resistant material properties to be able to ensure weather resistance over a specific time period. In this embodiment, it is likewise necessary to provide a sufficient venting of the paper sack during the filling process.

SUMMARY OF THE INVENTION

The present invention therefore deals with the improvement of a known paper sack to be able to satisfy the above-named demands. Increased product protection and/or an extended product stability of the filling material and/or an increased weather resistance of the packaging material should in particular be ensured by means of the improved paper sack and at the same time an economic manufacture and fast venting during filling should be achieved.

This object is achieved in accordance with the invention by a paper sack having the features herein.

In accordance with this embodiment of the invention, the paper sack comprises at least one paper layer having an overlap which is sealingly adhesively bonded toward the sack interior. In this respect, the layer of the paper layer facing toward the sack interior has an air-permeable region in the region of the overlap which is covered by the layer of the paper layer facing the sack exterior. This at least one paper layer at least regionally has a weatherproof coating facing the sack exterior. A watertight or at least water-repelling material coating is deemed to be weatherproof. The adhesive bond can be watertight and/or airtight.

A so-called weatherproof sack is provided by this embodiment which considerably increases the weather-resistance of the paper sack and can also protect the filling material filled in against external influences over a sufficient period on outdoor storage. The filling material can in particular be effectively protected from moisture or rain.

The weatherproof coating can be either watertight/water-repellent or ideally additionally gas-tight in order additionally to seal the paper sack against the passage of air, oxygen, CO2 or gaseous water. The coated paper layer furthermore has an overlap, with the overlapping margins preferably extending in parallel with the side margins of the paper sack so that the overlap extends from the base to the upper part in the manner of an overlap strip.

With the paper sacks in accordance with the invention, the overlap of the coated paper layer is sealingly adhesively bonded toward the sack interior, i.e. the layer of the inner layer facing the sack interior is adhesively bonded to the layer of the coated paper layer facing toward the sack exterior in the region of the overlap and the adhesive bond is located toward the sack interior in the marginal region of the overlap.

The adhesive bond is admittedly advantageously located directly at the margin of the overlap, but the adhesive bond does not have to be located directly at the edge of the overlap toward the sack interior. It can rather also be moved away from the edge of the overlap since in this case the effect intended by the invention can also still be achieved.

In the region of the overlap, the layer of the coated paper layer facing toward the sack interior has an air-permeable region or a region having a higher air permeability with respect to the remaining region of the paper layer. This air-permeable region is covered by the layer of the overlap facing the sack exterior. Due to this configuration, air can egress on the filling of the sack with filling material and can escape toward the outer side of the overlap since the adhesive bond hindering the air flow is arranged toward the sack interior. The adhesive bond toward the sack interior thus has a directing effect for the air flow as well as a stabilization effect for the coated paper layer in the region of the overlap, that is it serves the holding together of the material ends in the region of the overlap. It can thereby be achieved that the air leaving through the air-permeable region on the filling exits the overlap region completely to the outside. Furthermore, the stability is increased in the overlap region and the leak tightness in the filled state.

Furthermore, the spilling of filled material can be avoided by the overlap. It can be ensured by a suitable configuration of the air-permeable region that the respective filling material is held back in the sack while only air or mainly air can escape through the air-permeable region. With the fully filled sack, the air-permeable region is covered by the outer layer of the inner layer in the region of the overlap so that the penetration of substances or liquids from the outside is avoided.

A good venting on the filling is achieved by the embodiment in accordance with the invention with a simultaneously large product protection against external influences. The outer coating provides sufficient protection of the filling material from external influences such as moisture and water.

The aforesaid objective is furthermore achieved by a paper sack in accordance with the features herein. The paper sack accordingly has at least one coated paper layer having a gas-tight coating facing toward the sack interior. In addition, the coated paper layer has an overlap which is sealingly adhesively bonded toward the sack interior and the layer of the coated paper layer facing toward the sack interior in the region of the overlap has an air-permeable region which is covered by the layer of the coated paper layer facing toward the sack exterior. The configuration of the overlap consequently corresponds to the aforesaid first embodiment of the paper sack in accordance with the description herein. The difference from the first embodiment comprise the paper layer having an overlap not necessarily having an outwardly disposed coating, but rather being provided with an inner gas-tight coating. Further in accordance with the invention, at least one conventional layer is provided, in particular composed of paper or a paper composite, which is arranged between the filling space and the at least one paper layer having the overlap.

Consequently, the gas-tight coating does not have to be in direct contact with the filling material, but rather an interposed layer, in particular a paper layer, can be provided. It is avoided by the gas-tight coating that air, oxygen, $CO_2$ or gaseous water can penetrate from the outside in relevant quantities and can damage or destroy the filling material. These gases are namely primarily responsible for damage to sensitive products and for the lower storage stability of such filling materials.

Advantageous configurations of the two inventive paper sack embodiments in accordance with the description herein form the subject of the invention.

Provision can be made in an advantageous embodiment that the coated payer layer is coated at both sides. In this respect, it applies to the first embodiment that the paper layer coated at the outside can additionally comprise an inwardly disposed gas-tight coating. It applies to the second embodiment that an outwardly disposed water-repellent or water-resistant coating is provided in addition to the inwardly disposed gas-tight coating. This embodiment having a coating of the at least one paper layer at both sides is in particular suitable for single-layer paper sacks which only consist of a single paper layer. Paper layers coated at two sides can naturally also be considered for multi-layer paper sacks.

Provision can be made instead of the two-sided coating that, in addition to a paper layer having a coating at the outside, a further paper layer is provided which likewise comprises the described overlap having an air-permeable region and which comprises this one inwardly disposed coating. The same applies to the second embodiment variant of the invention, whereby a further paper layer having the described overlap and outwardly disposed coating, in particular a waterproof or water-resistant coating, is arranged in addition to the at least one paper layer having an inwardly disposed gas-tight coating. A gas-tight paper sack is provided by these advantageous embodiments, on the one hand, which suppresses the entry of oxygen, CO2 or gaseous water in relevant quantities from the outside into the filling material and at the same time provides a certain weather-resistance for outdoor storage.

In addition to the coated paper layers having overlaps, one or more conventional inner or outer layers can naturally be provided, in perpendicular paper layers or layers of a paper composite. Layers composes of another material or material composite are naturally also conceivable. Those layers are to be understood as conventional layers which either have no overlap or have an overlap without any separate air-permeable region.

The air-permeable region of the coated paper layer is ideally provided with one or more perforations, with said perforations preferably being formed by needling and/or by one or more slits. A sufficient exchange of air through the coated paper layer is thereby ensured. In another variant, the perforations can be formed as microperforations which are established, for example, in an electric or chemical manner and which are known from cigarette paper.

The air-permeable region of the coated paper layer can alternatively be provided by a highly porous material, that is the paper layer is characterized in the air-permeable region by different material properties which allow an exchange of air or a higher exchange of air with respect to the region which is not air-permeable.

It is furthermore conceivable to design the coated paper layer in the air-permeable region as air-permeable due to a regional omission of the coating.

An overlap region of wide design allows a greater surface of the air-permeable region of the overlap region and thus a better ventilation during filling. The higher material consumption for the inner layer is disadvantageous with a larger overlap region. It has proved advantageous in this conflict of goals for the overlap of the inner layer to be at least 3% of the sack periphery, further advantageously at least 10% of the sack periphery and even further advantageously at least 17%, but at most 25%, of the sack periphery.

In another preferred embodiment, the inwardly disposed coating and/or the outwardly disposed coating, i.e. the gas-tight coating and/or water-resistant/watertight coating is/are made up of multiple layers. The gas-tight coating preferably comprises a metalized film and/or a metal film. A particularly good gas-tightness can be achieved by such metalized films or metal films. Aluminum is very well suited as a metallic material. The metallic gas barrier provides a particularly good aroma protection in the food area.

The use of at least one lacquer layer and/or at least one wax layer and/or at least one plastic layer and/or at least one oil layer and/or likewise a metal layer or metal film is in particular suitable for the configuration of a water-resistant or water-repellent coating. With a multi-layer embodiment of the coating of the coated paper layer, an additional layer can preferably be applied via the water-resistant or water-repellant or gas-tight coating which is intended to serve the protection of the underlying coating. A destruction of, for example, a metal film or of a lacquer layer is thus prevented.

The gas-tight coating advantageously also forms a barrier for liquid so that a sealing against the ingress of water is also achieved.

In another preferred embodiment, additional adhesive bonds are additionally present in a middle region and/or in the marginal region of the overlap toward the sack exterior. These adhesive bonds further stabilize the overlap region. It is conceivable that at least one of these adhesive bonds is configured at least party as permeable, i.e. air-permeable, toward the sack exterior, advantageously by interrupted adhesive lines along the edge of the overlap toward the sack exterior.

In a particularly advantageous embodiment of the invention, a middle interrupted adhesive line can be provided in addition to the adhesive bond provided toward the sack interior, whereas the adhesive bond provided in the marginal region of the overlap toward the sack exterior is continuous and thus sealing. It is expedient in this case if the layer of the coated paper layer facing the sack exterior additionally likewise has an air-permeable region in the region of the overlap. This air-permeable region is then provided in the region between the adhesive bond disposed at the outer margin and the middle adhesive bond.

This air-permeable region can, for example, also be made by an omission of the coating and/or by a configuring of the paper layer with a highly porous material in this region. The region can equally be implemented by the provision of one or more perforations. The perforations are ideally designed in an analog manner to the perforations of the layer facing toward the sack interior. Additional protection is ensured by the advantageous embodiment since a hermetically sealing adhesive bond of the outer overlap is likewise ensured to the outside. In order nevertheless to allow an air exchange to the outside, the outer overlap must therefore also be equipped with a corresponding air-permeable region. The air exchange between the inwardly disposed air-permeable embodiment of the inner paper layer and the paper layer configured as air permeable at the outside takes place through the middle adhesive bond which is air-permeable, i.e. which is designed as a non-continuous adhesive strip. The air-permeable regions of the layer of the overlap facing toward the sack interior and toward the sack exterior are ideally not above one another or only slightly or partly overlap one another to produce an angled air passage from the inside to the outside.

In a further preferred embodiment, the paper sack or an individual paper layer have a plurality of overlaps in accordance with the invention, particularly preferably an overlap in accordance with the invention on the front side of the sack and a further overlap in accordance with the invention on the rear side of the sack. The venting of the sack can thus be improved on the filling and can be distributed over both sides.

In other preferred embodiments, the paper sack in accordance with the invention has further paper layers or layers of other materials suitable for sack manufacture outside the coated paper layer. These layers must also be configured such that they allow the air to escape to the outside on the filling. Suitable materials, preferably paper, coated paper, film and/or coated film can be considered for the sack manufacture. This may be useful with paper sacks coated on the outside. The covering then serves, for example, as additional protection for transport, etc. To achieve the weather-resistance, this additional covering is removed and the at least one paper layer having an outwardly disposed waterproof coating then forms the outermost surface of the paper sack.

BRIEF DESCRIPTION OF THE DRAWINGS

Various embodiments of the invention will be explained in more detail with reference to the following Figures. There are shown.

DESCRIPTION OF THE PREFERRED EMBODIMENTS

Figure 1:
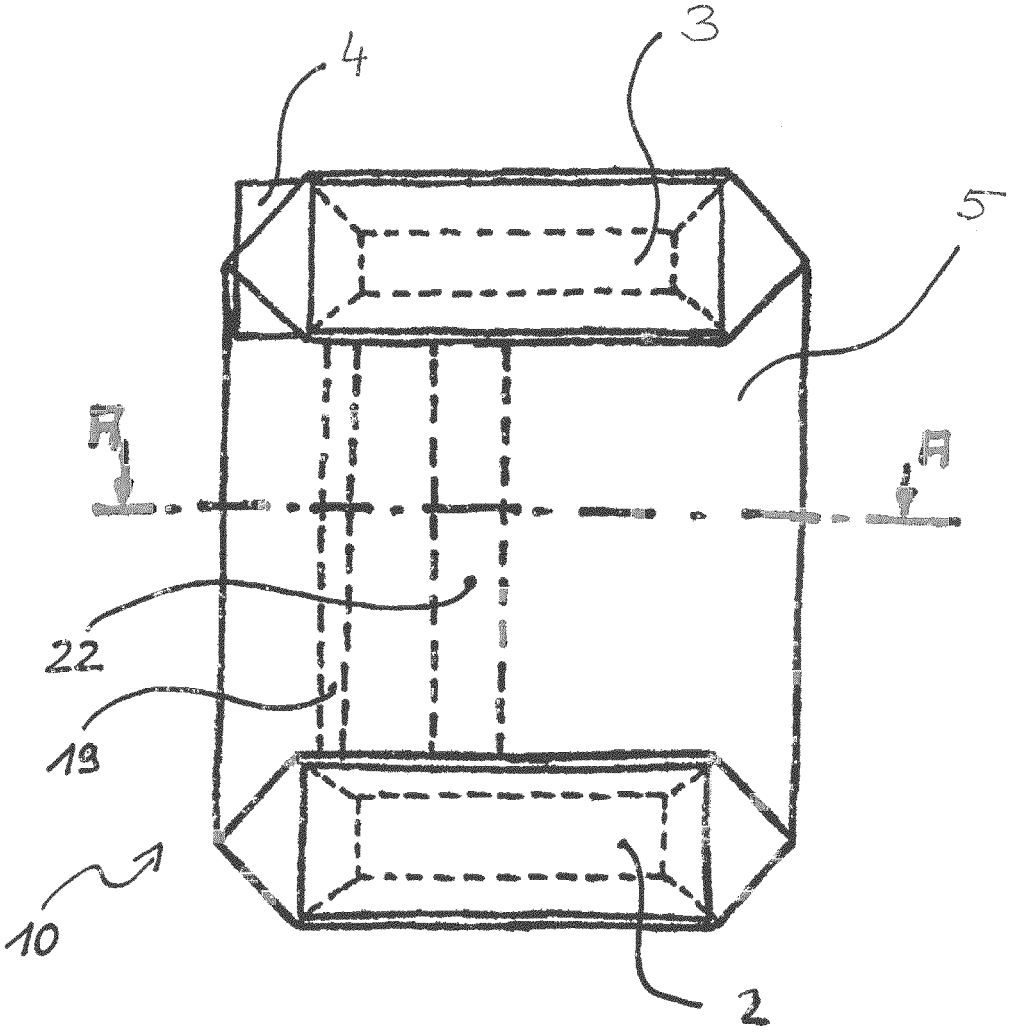
FIG. 1: a schematic plan view of a valve sack in accordance with the invention with a base and an upper part.

FIG. 1 shows a paper sack 10 in accordance with the invention having a cross bottom 2 and an upper part 3, wherein the base 2 and the upper part 3 are folded onto the front side 5 of the paper sack 10. The rear side of the sack which lies beneath the front side 5 cannot be seen here. A valve tube 4 is inserted in the upper part 3.

The basic principle of the paper sack in accordance with the invention of FIG. 1 shown can have a single-layer or a multi-layer design. In the case of FIG. 1, the paper sack comprises two layers, which is easily recognizable in the cross-sectional representation of FIG. 2*a* along the line A-A.

Figure 2A:
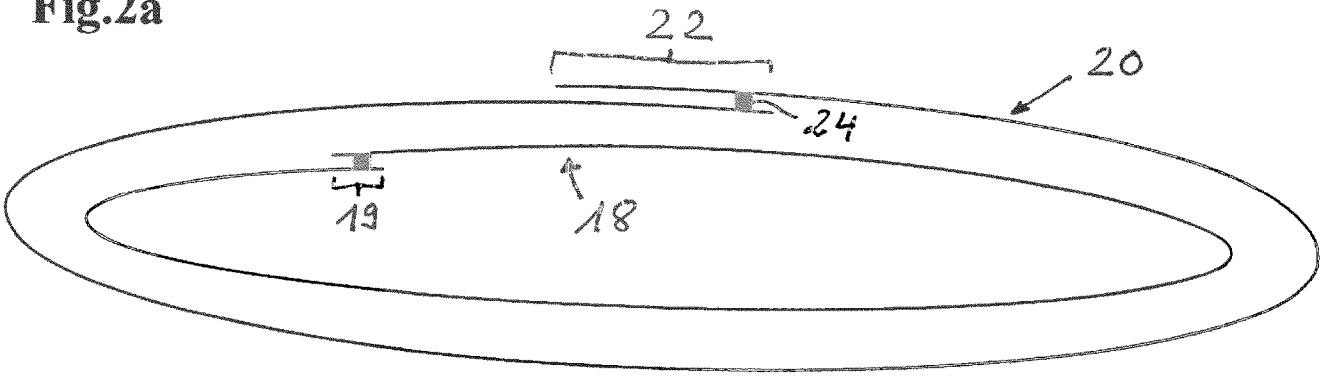
FIG. 2*a*: a schematic cross-section through the paper sack in accordance with the invention in accordance with FIG. 1 along the line A-A.

FIG. 2*a* shows a preferred variant of the paper sack in accordance with the invention as a multi-layer sack. The paper sack comprises an outwardly disposed coated paper layer 20 which has an overlap 22 having an adhesive point 24. The sealing adhesive bond 24 is formed toward the sack interior in this respect. The paper layer 20 additionally has an outwardly disposed coating having waterproof material properties. The coating is in particular watertight or water-repellant. In addition, the embodiment in accordance with FIG. 2*a* comprises a further inwardly disposed layer 18, for example composed of paper or of a paper composite. This paper layer also has an overlap 19 with an adhesive point 25. A comparison of the two overlaps 19, 22 shows that the overlap 22 is considerably wider. Both paper layers 20 form a tube section of the paper sack of FIG. 1 between the base 2 and the upper part 3. The wider overlap 22 serves the sufficient venting of the paper sack during its filling.

Figure 2B:
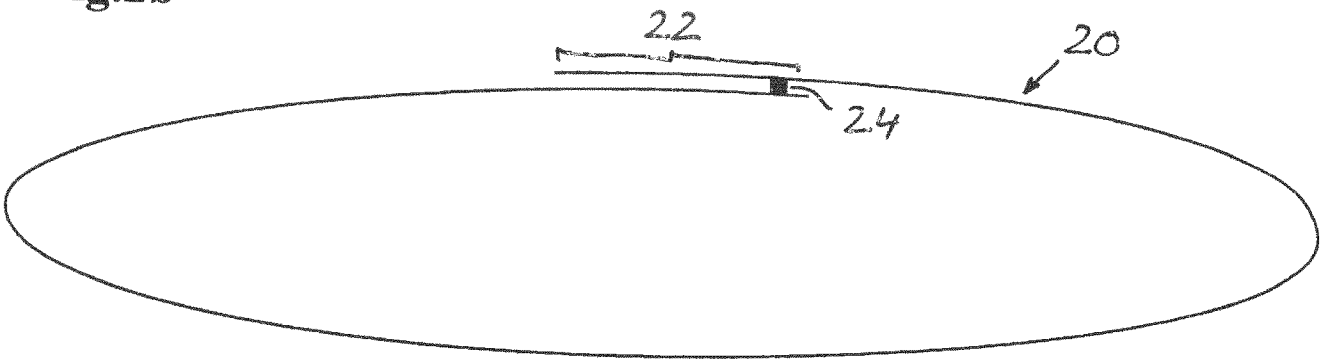
FIGS. 2*b*, 2*c*: two further cross-sectional representations along the line A-A in accordance with alternative embodiments.

FIG. 2*b* shows an alternative variant of the paper sack as an inlay sack. In this respect, the outer paper layer 20 is designed analogously to the embodiment of FIG. 2*a*.

Figure 2C:
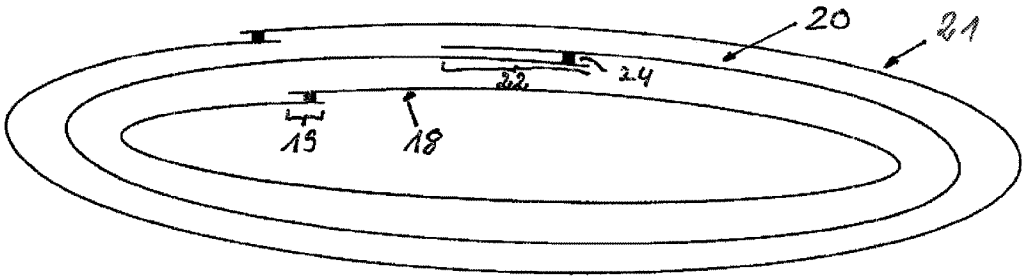

FIG. 2*c* shows a variant with a coated paper layer 20 which is embedded between two further layers 18 and 21. The overlaps of the outwardly disposed and inwardly disposed layers 18, 21 are likewise formed considerably narrower than the overlap 22 of the coated paper layer 20. The paper layer 20 can in this respect likewise be deigned like the paper layer of FIGS. 2*a*, 2*b*.

It applies in general that the coating of the paper layer 20 of the FIGS. 2*a*, 2*b*, 2*c* can also only be coated inwardly disposed in a water-resistant/water-repellent or gas-tight manner. A paper layer 20 having a two-sided coating is also conceivable, for example with an inwardly disposed gas-tight coating and an outwardly disposed water-resistant/water-repellant coating. This embodiment is in particular useful with the inlay sack in accordance with FIG. 2*b*. In general, the paper layer 20 could naturally also be designed without a coating, with then a better air permeability being able to be achieved by means of the increased overlap 22 with respect to the non-overlapped region of the paper layer 20. It is also conceivable that further paper layers having increased overlaps are provided in the examples of FIGS. 2*a*, 2*b*, 2*c* in order, for example, to be able to provide sufficient venting at at least two sack sides. More conventional layers 18, 21 can naturally also be provided.

Figure 3:
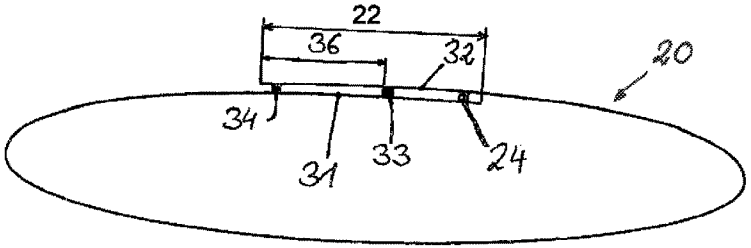
FIG. 3: the coated paper layer of one of the embodiments in accordance with FIGS. 2*a*, 2*b*, 2*c* with an enlarged section of the overlap with adhesive bond.

FIG. 3 shows the coated paper layer 20 with an enlarged detail of the overlap 22. The layer 31 of the coated paper layer 20 facing toward the sack interior overlaps with the outwardly facing layer 32 of the coated layer 20 in the region of the overlap 22. The overlap 22 is sealingly adhesively bonded by means of the adhesive bonding 24 at its margin facing toward the sack interior.

In addition to the adhesive bonding 24, the overlap 22 comprises further adhesive points 33, 34, with the adhesive point 33 being designed as an interrupted adhesive strip in the longitudinal direction of the sack of FIG. 1 and with the adhesive bond 34 being a continuous adhesive strip extending in the longitudinal direction. The advantages of the additional adhesive bonds 33, 34 will be looked at later with respect to FIG. 5.

Figure 4:
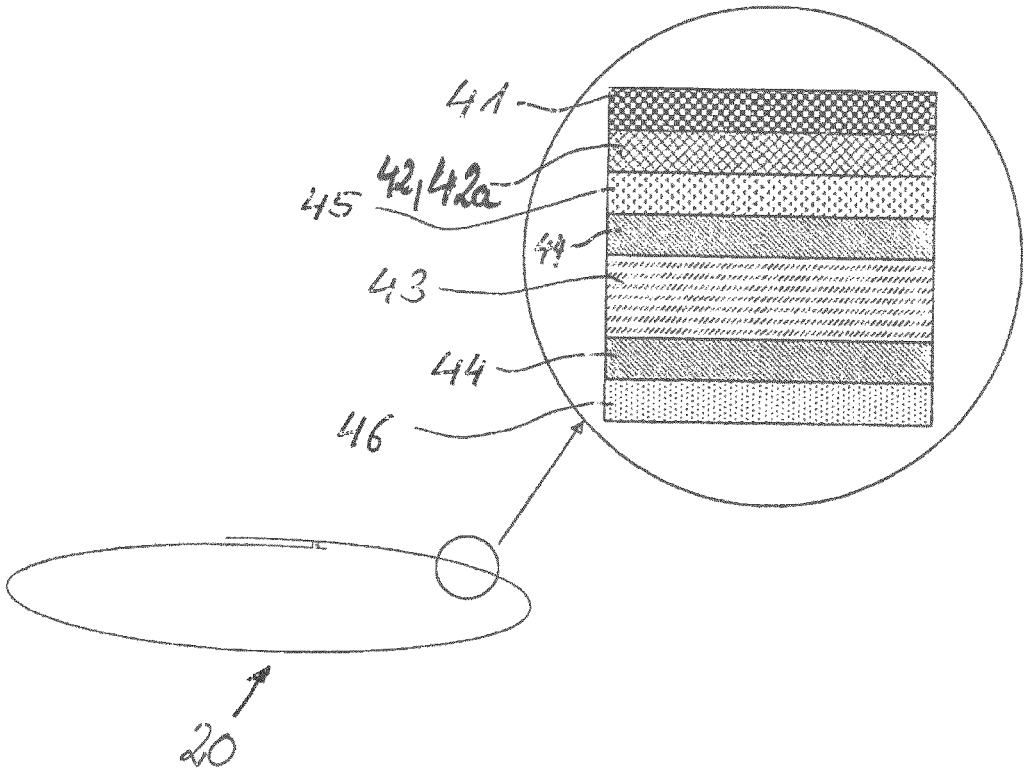
FIG. 4: an enlarged representation of the layer design of the coating in accordance with the present invention.

FIG. 4 shows the layer design of the coated layer 20 by way of example. In the case of an inwardly disposed coating, the paper layer has a carrier layer 41 of paper at its outer side. A metallization 42, which is preferably formed of aluminum, follows inwardly as the next layer. The metalizing 42 is protected by a plastic coating whose core 43 comprises PET (polyethylene terephthalate) or comparable plastics. The core 43 is provided at both sides with a surface layer or a surface treatment 44. A lacquer layer 45 is located between the metallization 42 and the surface treatment 44. A corona pre-treatment 44, which then forms the innermost layer toward the sack interior, is present on the outer surface treatment 44. The plastic coating applied to the metallic gas barrier protects the metal layer from damage on the sack manufacture.

The paper layer 20 has a carrier layer 41 of paper at its inner side for an outwardly disposed coating. The outwardly following layer 42*a* then comprises a water-resistant or water-repellant material, preferably a lacquer layer, an oil layer, a wax layer, a plastic layer or a metal layer, which particularly preferably consists of aluminum. The layer 42*a* is protected, analog to the inner coating, by a plastic coating whose core 43 comprises PET (polyethylene terephthalate) or comparable plastics. The core 43 is provided at both sides with a surface layer or a surface treatment 44. A lacquer layer 45 is located between the metallization 42 and the surface treatment 44. A corona pre-treatment 46, which then forms the outermost layer toward the sack exterior, is present on the outer surface treatment 44. The plastic coating applied to the water-resistant or water-repellant layer 42*a* protects this layer from damage on the sack manufacture. The described layer design can be applied to both sides of the carrier material 41 for a two-sided coating.

Figure 5:
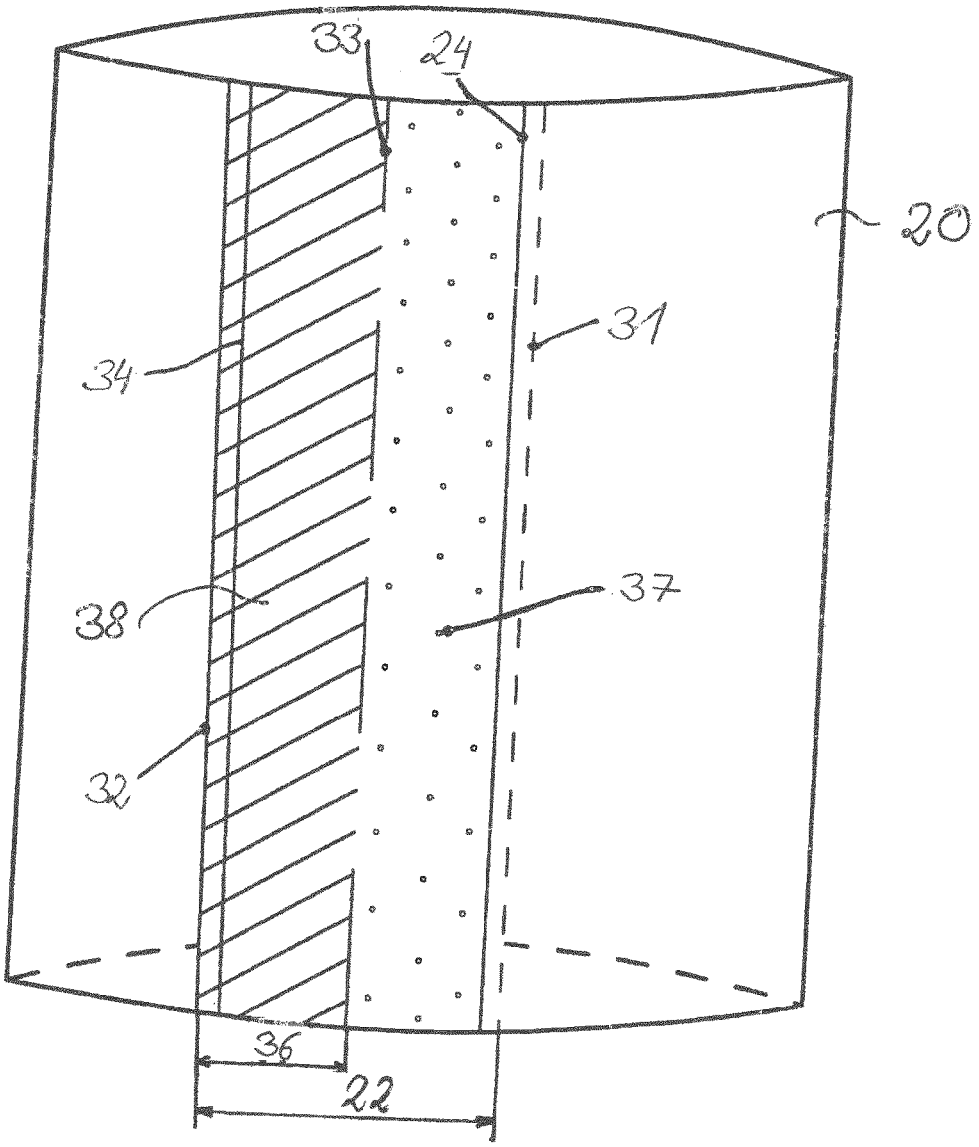
FIG. 5: a tube section of the coated paper layer of the valve sack in accordance with the embodiment of FIG. 2*a*.

FIG. 5 now shows a specific embodiment of the overlap region 22 of the paper layer 20 in accordance with the invention. The total overlap region 22 of the layer 31 facing the sack interior and the layer 32 facing the sack exterior is adhesively bonded in an air-tight and water-tight manner by means of the continuous adhesive strip 24. In addition to the existing adhesive bond 34, there is a parallel adhesive strip 33 which extends in the middle section of the overlap 22. This adhesive strip 33 is interrupted, whereby a gas discharge to the outside is permitted, i.e. from the sack interior to the outside.

Perforations 37 in the form of needling are provided between the two adhesive bonds 24, 33 on the inner layer 31 and form the air-permeable region of the overlap 22. Air can thus escape to the outside during the filling process via the perforations 37 and the interrupted adhesive bond 33 despite the sealing adhesive bond 24 and the coating of the paper layer 20. The air permeability can naturally also be achieved by using a highly porous material in this region of the paper layer 20. There is additionally the possibility of omitting an applied coating of the paper layer 20 in this region in order thus to provide the required air permeability.

In general, the outer layer 32 can be cut off after the adhesive bonding 33. Better protection of the filling material results, however, when the outer layer 32—as shown in FIG. 5—projects beyond the adhesive bond 33 and is adhesively bonded at the marginal side to the inner layer 31 by a continuous adhesive strip 34. This adhesive bond 34 is also preferably sealing. In order nevertheless to provide sufficient air egress, the overlap region 36 facing toward the sack exterior of the layer 32, shown hatched in FIG. 5, facing the sack exterior must also be air-permeable. This can be achieved analogously to the inner layer 31, for example by omitting a coating in the region 36 or by using a highly porous paper or of perforations. The air egress region 36 and the perforation region 37 are therefore not above one another, but rather displaced laterally with respect to one another.

The air which arises on the filling of the sack 10 and which escapes through the perforation 37 of the layer 31 facing the sack interior can now escape to the outside through the overlap region 36 facing the sack exterior.

A number of advantages are achieved with the invention. The paper sack can in particular be well vented during filling due to the configuration of the overlap 22 and high product protection of the filling material or a weather-resistant design of the paper sack 10 can be achieved by the gas-tight coating at the inner side or by a water-resistant coating at the outer side of the sack.

The design of the overlap 22 is used, for example, not only on coated layers of a paper sack, but is rather also provided for those layers which do not have a corresponding coating either at the inner side or at the outer side and generally have air-permeable properties. The configuration of a corresponding overlap with the air-permeable region is in particular desirable if the general material property of the layer does not have sufficient air permeability. In this case, a better venting can be achieved on the filling of the paper sack by the overlap and the formation of an air-permeable region having a higher air permeability with respect to the remaining material region of the layer. Against this background, the embodiment of a paper sack is expedient in which at least any designed layer, for example the inner layer, outer layer or an intermediate layer, is provided with a corresponding overlap. This sack does not necessarily have to comprise a coated paper layer or a coated paper layer having an overlap 22.

In a further possible scenario, provision can likewise be made that a layer, not consisting of paper, introduced as an additional barrier layer is likewise provided with the correspondingly described overlap 22. Such a barrier layer can, for example, be a plastic film which is intended to protect the filled in filling material from ingressing liquid or gases. To achieve a sufficient venting during the filling of the paper sack, this plastic film or another gas-tight layer can be provided with the corresponding overlap. This sack does not necessarily have to comprise a coated paper layer or a coated paper layer having an overlap 22. In addition, even further perforations or air-permeable regions designed in a different manner can be provided in the material region of the plastic film outside the overlap 22.

The invention claimed is:

1. A paper sack (10) for bulk material such as cement, gypsum, granulate, animal feed or similar, having a base (2), and an upper part (3) which is disposed opposite the base and in which a valve tube (4) is arrangable for filling the paper sack (10), wherein the paper sack (10) has at least one paper layer (20) having an overlap (22), an inner layer (31) of the at least one paper layer (20) facing a sack interior has a perforated air-permeable region (37) in the region of the overlap (22), wherein the perforated air-permeable region which is covered by an outer layer (32) of the at least one paper layer (20) facing a sack exterior, the at least one paper layer (20) has a water-repellent/water-tight coating (42*a*) facing the sack exterior at least regionally, a first adhesive bond (24) continuously extends without interruption along a line between the inner and outer layers (31, 32) between the sack interior and the perforated air-permeable region (37), a second adhesive bond (33) discontinuously extends with interruptions along a line between the inner and outer layers (31, 32) on an opposite side of the perforated air-permeable region (37), a third adhesive bond (34) continuously extends without interuption along a line between the inner and outer layers (31, 32) on a side of the second adhesive bond (33) opposite the perforated air-permeable region (37), and said outer layer (32) of said overlap (22) comprises an air-permeable region (36) formed by omitting the water repellent/water-tight coating and positioned between said second and third adhesive bonds (33, 34) such that said air-permeable regions (37, 36) of said inner and outer layers (31, 32) are laterally and circumferentially offset from one another.

2. The paper sack (10) in accordance with claim 1, wherein the at least one paper layer (20) is coated at both sides with an inwardly disposed gas-tight coating (42) and with the outwardly disposed water-repellent/water-tight coating (42*a*), except in the air-permeable region (36) of the outer layer.

3. The paper sack (10) in accordance with claim 1, wherein the water-repellent/water-tight coating (42*a*) of the at least one paper layer (20) facing the sack exterior forms the outer surface of the paper sack (10).

4. The paper sack (10) in accordance with claim 1, wherein the at least one paper layer (20) is coated in a gas-tight manner at an inner side thereof, except in the air-permeable region (36) of the outer layer.

5. The paper sack (10) in accordance with claim 1, wherein the paper sack (10) comprises one or more conventional inner layers and/or outer layers (18, 21) of paper.

6. The paper sack (10) in accordance with claim 1, wherein the overlap (22) of the at least one paper layer (20) amounts to at least 3% of the sack periphery.

7. The paper sack (10) in accordance with claim 6, wherein the overlap (22) of the at least one paper layer (20) amounts to at least 10% of the sack periphery.

8. The paper sack (10) in accordance with claim 7, wherein the overlap (22) of the at least one paper layer (20) amounts to at least 17% to a maximum of 25% of the sack periphery.

9. The paper sack (10) in accordance with claim 1, wherein the water repellent/water-tight coating (42, 42*a*) of the at least one paper layer is of multi-layer design.

10. The paper sack (10) in accordance with claim 1, wherein the water repellent/water-tight coating (42, 42*a*) of the at least one paper layer (20) comprises at least one metal layer (42) and/or at least one lacquer layer (42*a*) and/or at least one oil layer and/or at least one wax layer and/or at least one plastic layer.

11. The paper sack (10) in accordance with claim 1, wherein the at least one paper layer (20) has further overlaps (22) which are configured such that one overlap is formed on the front side (5) of the sack and a further one is formed on the rear side.

12. The paper sack (10) in accordance with claim 1, wherein one or more further material layers (21) are present as a covering of the at least one paper layer (20), which further material layers allow air to escape to the outside on the filling of the paper sack (10) and which are formed from paper, coated paper, film and/or coated film.

13. A paper sack (10) for bulk material such as cement, gypsum, granulate, animal feed or similar, having a base (2), and an upper part (3) which is disposed opposite the base (2) and in which a valve tube (3) is arrangable for filling the paper sack (10), wherein the paper sack (10) has at least one coated paper layer (20), having a gas-tight coating (42) facing a sack interior, the at least one coated paper layer (20) has an overlap (22), an inner layer (31) of the at least one coated paper layer (20) facing the sack interior has a perforated air-permeable region (37) in the region of the overlap (22), wherein the perforated air-permeable region which is covered by an outer layer (32) of the at least one coated paper layer (20) facing a sack exterior, the paper sack (10) is of multi-layer design and a paper layer (18) is arranged between the filling material and the at least one coated paper layer (20), a first adhesive bond (24) continuously extends without interruption along a line between the inner and outer layers (31, 32) between the sack interior and the perforated air-permeable region (37), a second adhesive bond (33) discontinuously extends with interruptions along a line between the inner and outer layers (31, 32) on an opposite side of the perforated air-permeable region (37), a third adhesive bond (34) continuously extends without interruption along a line between the inner and outer layers (31, 32) on a side of the second adhesive bond (33) opposite the perforated air-permeable region (37), and the perforated air-permeable region (37) of said inner layer (31) is positioned between said first and second adhesive bonds (24, 33) and said outer layer (32) of said overlap (22) comprises an air-permeable region (36) formed by omitting the gas-tight coating and positioned between said second and third adhesive bonds (33, 34) such that said air-permeable regions (37, 36) of said inner and outer layers (31, 32) are laterally and circumferentially offset from one another.

* * * * *